US005186450A

United States Patent [19]

Vits

[11] Patent Number: 5,186,450

[45] Date of Patent: Feb. 16, 1993

[54] APPARATUS FOR OVERLAPPING AND LAYING DOWN SHEETS CUT FROM A WEB OF MATERIAL BY A CROSSCUTTER

[75] Inventor: Hilmar Vits, Leichlingen, Fed. Rep. of Germany

[73] Assignee: Heidelberger Druckmaschinen AG, Heidelberg, Fed. Rep. of Germany

[21] Appl. No.: 721,130

[22] Filed: Jun. 27, 1991

[30] Foreign Application Priority Data

Jun. 27, 1990 [DE] Fed. Rep. of Germany ..... 4020398

[51] Int. Cl.[5] ..... B65H 29/68

[52] U.S. Cl. ..... 271/183; 271/188; 271/197

[58] Field of Search ..... 271/182, 183, 188, 194, 271/196, 197, 209, 230, 231

[56] References Cited

U.S. PATENT DOCUMENTS

| | | | |
|---|---|---|---|
| 4,019,731 | 4/1977 | Vits | 271/183 |
| 4,247,094 | 1/1981 | Vits | 271/183 |
| 5,060,928 | 10/1991 | Vits | 271/182 |

*Primary Examiner*—Robert P. Olszewski
*Assistant Examiner*—Boris Milef
*Attorney, Agent, or Firm*—Herbert L. Lerner; Laurence A. Goldberg

[57] ABSTRACT

Apparatus for overlapping and depositing sheets cut by a crosscutter from a web of material, including a conveying device disposed immediately downstream from the crosscutter in a conveying direction of the sheets for conveying the sheets at a conveying speed along a conveying path and for further guidance thereof to floating strips extending over a sheet-pile stacking location, a combined conveying and braking device disposed immediately upstream of the stacking location and including a camshaft disposed above the conveying path of the sheets, the camshaft carrying conveying and braking cams and being rotatable in synchronism with the crosscutter, slide elements and brake elements disposed one after the other along a circle of rotation of the cams below the sheet conveying path and at a distance from one another corresponding to the length of the cams, a device for rotating the cams at the sheet conveying speed, a device for rotating the brake elements at a braking speed, the cams having a constant radius and being engageable successively with the slide elements and the brake elements both for conveying and braking each of the sheets.

10 Claims, 3 Drawing Sheets

APPARATUS FOR OVERLAPPING AND LAYING DOWN SHEETS CUT FROM A WEB OF MATERIAL BY A CROSSCUTTER

The invention relates to an apparatus for overlapping and laying down or depositing sheets cut from a web of material by a crosscutter, including a conveying device disposed immediately downstream from the crosscutter in a conveying direction of the sheets for feeding the sheets for further guidance to floating strips extending over a sheet-pile stacking location; a combined conveying and braking device disposed immediately upstream of the stacking location and including a camshaft disposed above the conveying path of the sheets and equipped with conveying and brake cams, and being rotatable in synchronism with the crosscutter, slide elements and brake elements disposed below the conveying path and associated with the conveying and brake cams, the conveying and brake cams being rotatable at conveying speed and the brake elements at braking speed.

Crosscutters of the foregoing general type have become known heretofore from the German patent publications DT No. 25 321 880 B2, DE No. 23 48 320 C3 and DE No. 30 07 435 C2. In all these prior art crosscutters the sheets are moved out of the conveying plane and into the zone of action of a braking device by means of cams of a camshaft which act upon the trailing edge of the sheets. In the prior art crosscutter of the general type described hereinbefore, that part of the conveying and braking device which is disposed below the conveying path is formed of freely rotatable guide rollers disposed on a common shaft and associated with the conveying cams, and brake discs associated with the brake cams and disposed non-rotatably on the shaft and co-rotating therewith. With such a crosscutter there is a risk that if a sheet is violently braked, the end thereof has not yet left the zone of the guide rollers when the conveying cams resume their conveying action. A renewed application of conveying forces on the sheets causes over-stressing thereof by reacceleration and consequent compression or upsetting of the end thereof.

In an improved crosscutter of the aforementioned general type which is described in German Patent No. 38 36 604, a reliable separation between conveying and braking is achieved with as smooth a transition as possible from conveying to braking. In the latter heretofore known crosscutter, just as in those mentioned hereinbefore, the braking path or travel on rings is very short, so that hard pressure must be exerted by the brake cam on the sheet supported by the brake ring. In the case of rapid crosscutters located downstream from printing machines, when both sides of the sheets have been freshly printed, the printing image is damaged, and especially so if the paper was incompletely dried in order to protect it, and the tips of bristles, with which the cams may be equipped, slide hard thereover.

To decelerate or brake the sheets to be deposited at a sheet pile stacking location to a speed which is noncritical immediately prior to the deposit thereof, it has also been known heretofore from German Published Non-Prosecuted Application No. 39 20 407 to dispose conveying rollers slowly rotating in a suction box below the conveying path immediately upstream of the stacking location and to dispose a camshaft with cams above the conveying path. By means of the cams, the sheet is deflected downwardly from the conveying path and forced towards the conveying rollers against which it is drawn by the negative pressure in the suction box. Because in this case also, the contact between the conveying rollers and the sheet is limited to a very narrow zone, a considerable braking effect can be achieved only with a correspondingly high contact pressure, something which is disadvantageous, however, to a freshly printed image.

It is accordingly an object of the invention to provide an apparatus of the foregoing general type which enables the sheets to be decelerated or braked with a comparatively low braking pressure.

With the foregoing and other objects in view, there is provided, in accordance with the invention, an apparatus for overlapping and depositing sheets cut by a crosscutter from a web of material, including a conveying device disposed immediately downstream from the crosscutter in a conveying direction of the sheets for conveying the sheets at a conveying speed along a conveying path and for further guidance thereof to floating strips extending over a sheet-pile stacking location, comprising a combined conveying and braking device disposed immediately upstream of the stacking location and including a camshaft disposed above the conveying path of the sheets, the camshaft carrying conveying and braking cams and being rotatable in synchronism with the crosscutter, slide elements and brake elements disposed one after the other along a circle of rotation of the cams below the sheet conveying path and at a distance from one another corresponding to the length of the cams, means for rotating the cams at the sheet conveying speed, means for rotating the brake elements at a braking speed, the cams having a constant radius and being engageable successively with the slide elements and the brake elements both for conveying and braking each of the sheets.

In the apparatus according to the invention the effective braking surface is increased in comparison with that in the related prior art, because braking is performed with twice the number of brake cams and, moreover, over a greater distance due to the suction belts. The changeover from conveying to braking takes place without interruption because, due to the length of the cams, which corresponds to the spacing between the slide elements and the suction belts, the braking operation is initiated only at the instant when the conveying operation at the slide elements is terminated.

In accordance with another feature of the invention, the brake elements are formed as suction belts.

In accordance with a further feature of the invention, the apparatus includes a drive for the camshaft, and means for preadjusting the camshaft via a differential with increasing conveyor speed in the conveying direction so that the cams force leading ends of the sheets being conveyed a slight additional distance further forward and relatively long trailing ends of the sheets are left free downstream from the cams, the length of the free trailing ends of the sheets corresponding to an increase in braking travel of the sheets.

With this feature, the deceleration or braking is deliberately initiated earlier on, thereby permitting a longer brake travel in order to reduce the sheet to a speed which is non-critical for the deposition without increasing the braking pressure. This feature, on the one hand, also enables the full length of the zone of the suction belts over which the cams pass to be used for the braking operation, even at different conveying speeds, while, on the other hand, the full length is again released or freed for the following sheet because at the termination of braking, the sheet is conveyed via the suction belts out of the braking conveying distance by the end of the sheet which has arrived at the start of the braking conveying distance. Due to the speed-dependent phase adjustment , the speed of the suction belts can be maintained at a constant low proportional value of the conveying speed. In comparison with conventional crosscutters, such as are disclosed in the German patent publications DE No. 30 07 435 C2 and DE No. 38 36 604 A1, this provides considerable advantages because, at a suction belt speed of 5% of the conveying speed, for example, the sheet held at its end by the suction belts is conveyed in full at 5% of the speed until it is located over the stack, and the overlapping sheet can no longer accelerate the overlapped sheet by friction beyond the 5%.

In accordance with an additional feature of the invention, the suction belts have a braking zone located in the circle of rotation of the cams, the braking zone having a length corresponding at least to the length of the cams.

In accordance with an added feature of the invention, the suction belts downstream from the braking zone thereof, have a conveying zone extending outside of the circle of rotation of the cams, the suction belts being rotatable at a predetermined speed so that the respective travel path thereof over both the braking and the conveying zones is completed in a sheet sequence period.

Thus, following the deceleration or braking conveying distance, the suction belts can have a pure conveying distance extending outside the circle of rotation of the cams and can rotate at such a speed that its path of travel over both the braking and conveying zone distances is covered during the sheet sequence period. This prevents friction from occurring between the overlapping sheets in the vicinity of the suction belts.

In accordance with yet another feature of the invention, a first conveying element of the conveying device is cooperatively engageable with the cams below the conveying path and constitutes a conveying roller.

In accordance with yet a further feature of the invention the cams are carried by mutually spaced-apart discs on the camshaft, and the conveying device comprises rollers disposed in the spaces between the cams and the discs thereof. This produces a compact construction.

In accordance with yet an added feature of the invention, the same cams are in successive engagement with the slide elements and the brake elements for conveying and braking the sheets.

In accordance with yet an additional feature of the invention, the slide elements and the brake elements are cooperatively engageable, respectively, with the conveying and braking cams, and only the conveying cams of the cooperating slide elements and conveying cams, and only the brake elements of the cooperating braking cams and brake elements are actionable upon the sheets for determining the speed thereof.

In accordance with a concomitant feature of the invention, the brake elements are formed as suction belts, the slide elements including a slide rod located between the conveying roller and the suction belts and engageable with the cams at a contact location spaced a distance corresponding to the length of the cams from respective contact locations of the conveying roller and the suction belts with the cams.

Other features which are considered as characteristic for the invention are set forth in the appended claims.

Although the invention is illustrated and described herein as embodied in an apparatus for overlapping and laying down sheets cut from a web of material by a crosscutter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
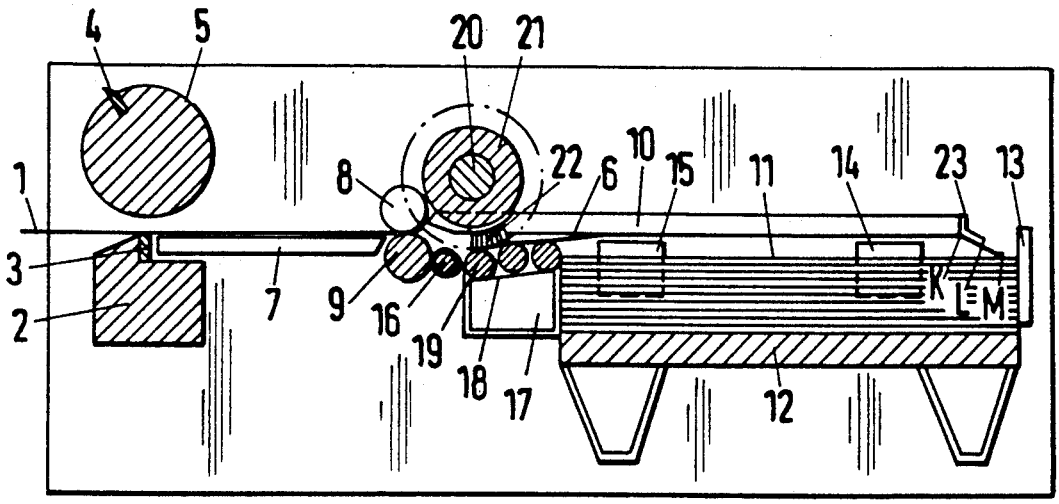
FIG. 1 is a diagrammatic side elevational view, partly in cross-section, of an apparatus for overlapping and laying down or depositing sheets cut by a crosscutter or sheeter from a web of material.
Figure 2:
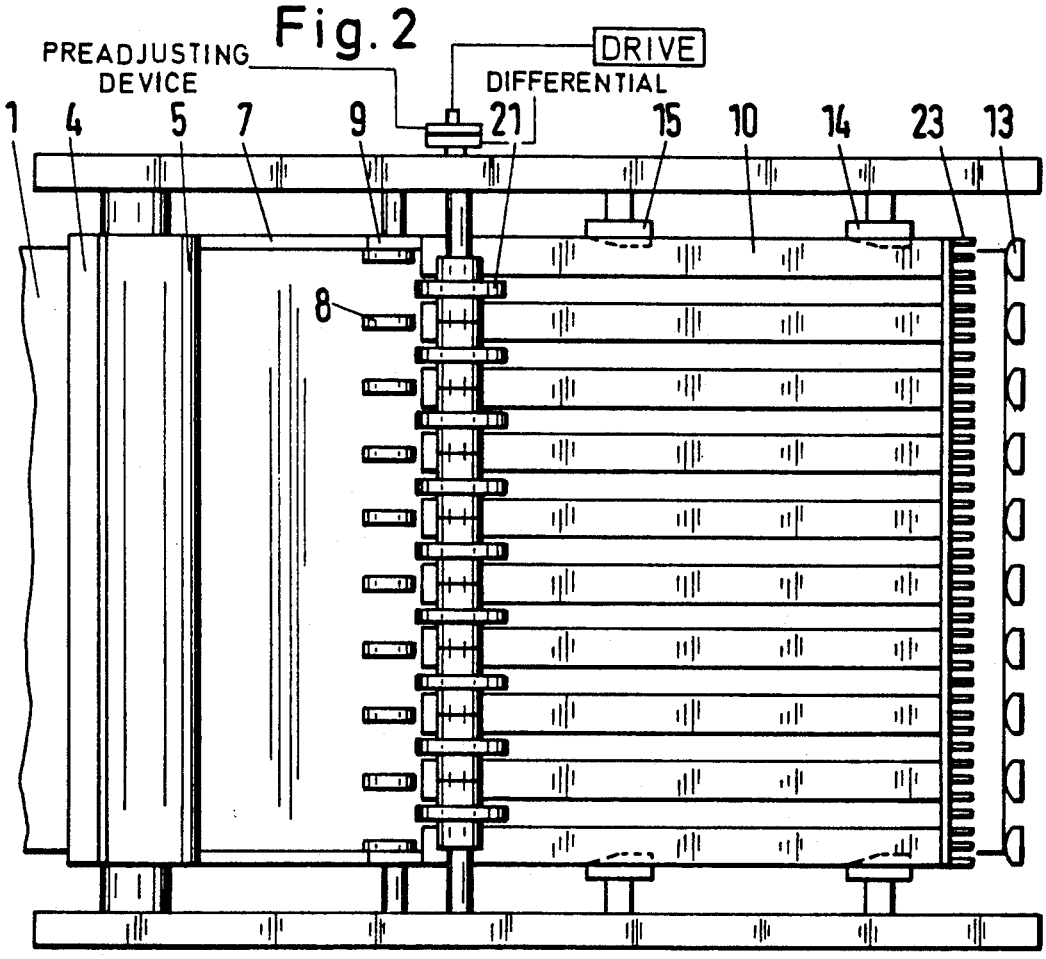
FIG. 2 is a top plan view of FIG. 1.

Referring now to the figures of the drawing and, more particularly, to FIGS. 1 and 2 thereof, there is shown therein a web of material 1 which is fed to a crosscutter made up of a beam 2 having a lower blade 3 attached thereto and a rotary blade 4 which cooperates therewith and is mounted on a blade drum 5. The crosscutter 2 to 5 cuts the web of material 1 into individual sheets 6. The sheets 6 are conveyed, on the one hand, by floating strips 7 supplied with blown air and disposed below the conveying path and, on the other hand, by a conveying device formed of upper conveying rollers 8 and a lower conveying roller 9. In the foregoing arrangement, a starting end of the web of material 1 has been seized beforehand by the conveying device 8, 9 when the web of material 1 is cross-cut. This ensures that the sheets 6 are conveyed accurately at a speed determined by the conveying device 8, 9. The floating strips 7 extend to the conveying roller 9. The floating strips 10 disposed above the conveying path of the sheets 6 adjoin the conveying rollers 8. The floating strips 10 extend to a great extent over a pile or stacking location 11. The floating strips 7 and 10 exert a conveying action on the sheets. Due to the conveying action of the floating strips 7 and 10, the web of material 1 and the sheet 6, namely the leading sheet, cut therefrom by the crosscutter 2 to 5 and held at its end by the conveying device 8, 9, are drawn tight or tautened.

A sheet pile 11 which is disposed on a lowerable pallet 12 and on which the arriving sheets 6 are disposed one above the other, is bounded at its end face by stop strips 13 and laterally by adjustable guide strips 14 and 15.

Figure 3:
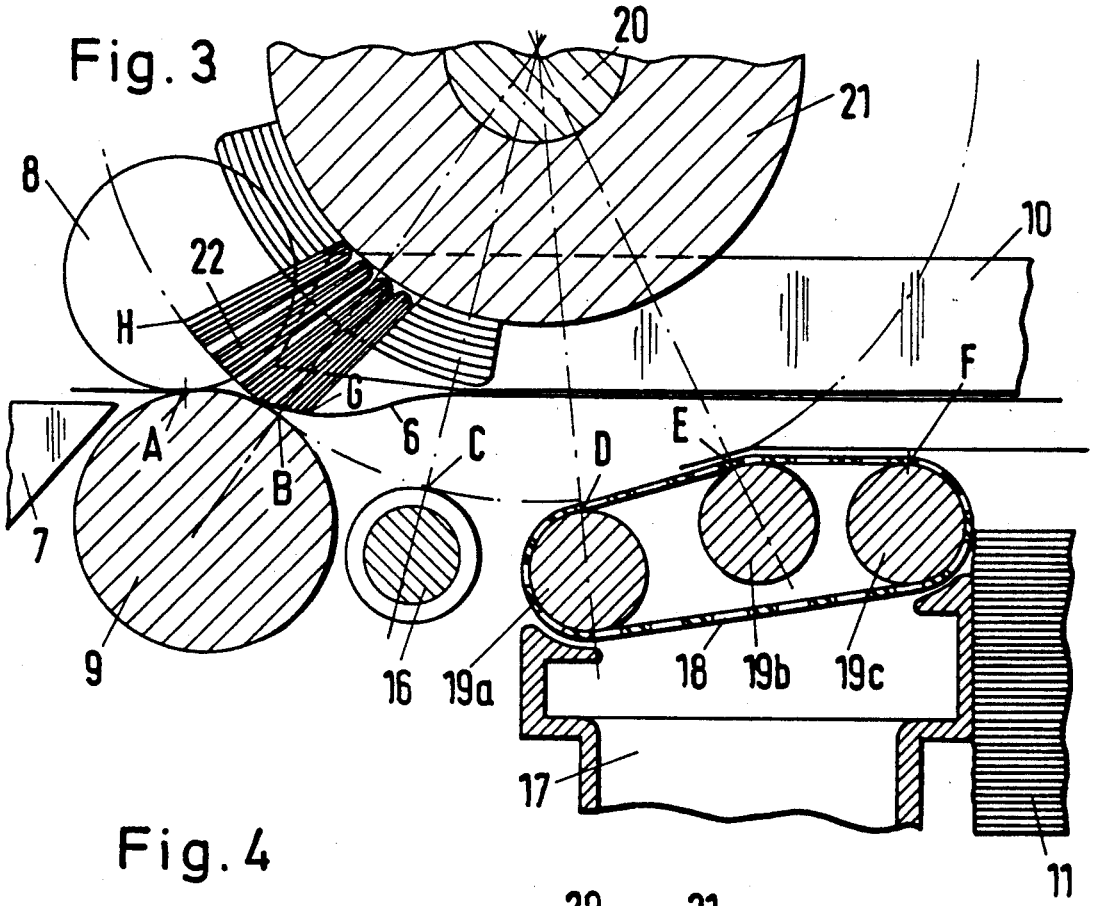
FIGS. 3 to 5 are enlarged fragmentary cross-sectional views of FIG. 1 showing part of the apparatus in different phases of sheet braking and overlapping operations thereof.
Figure 4:
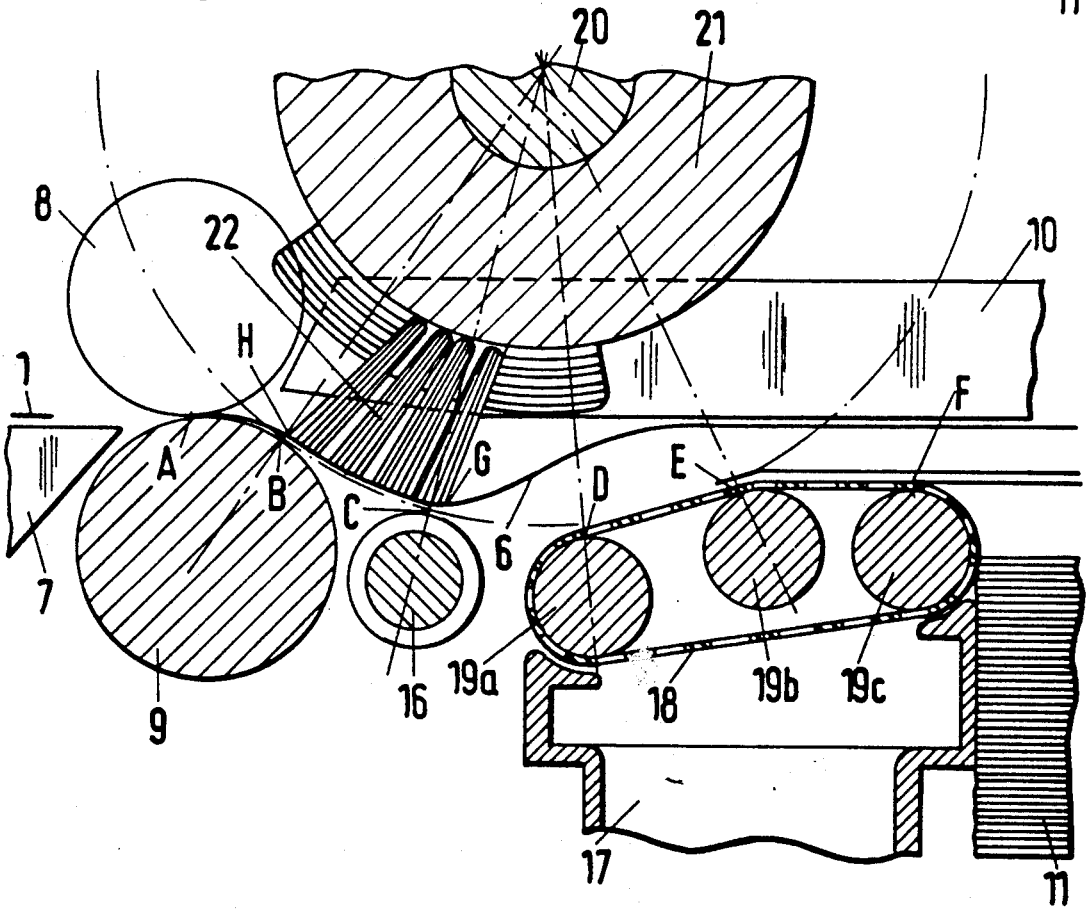
Figure 5:
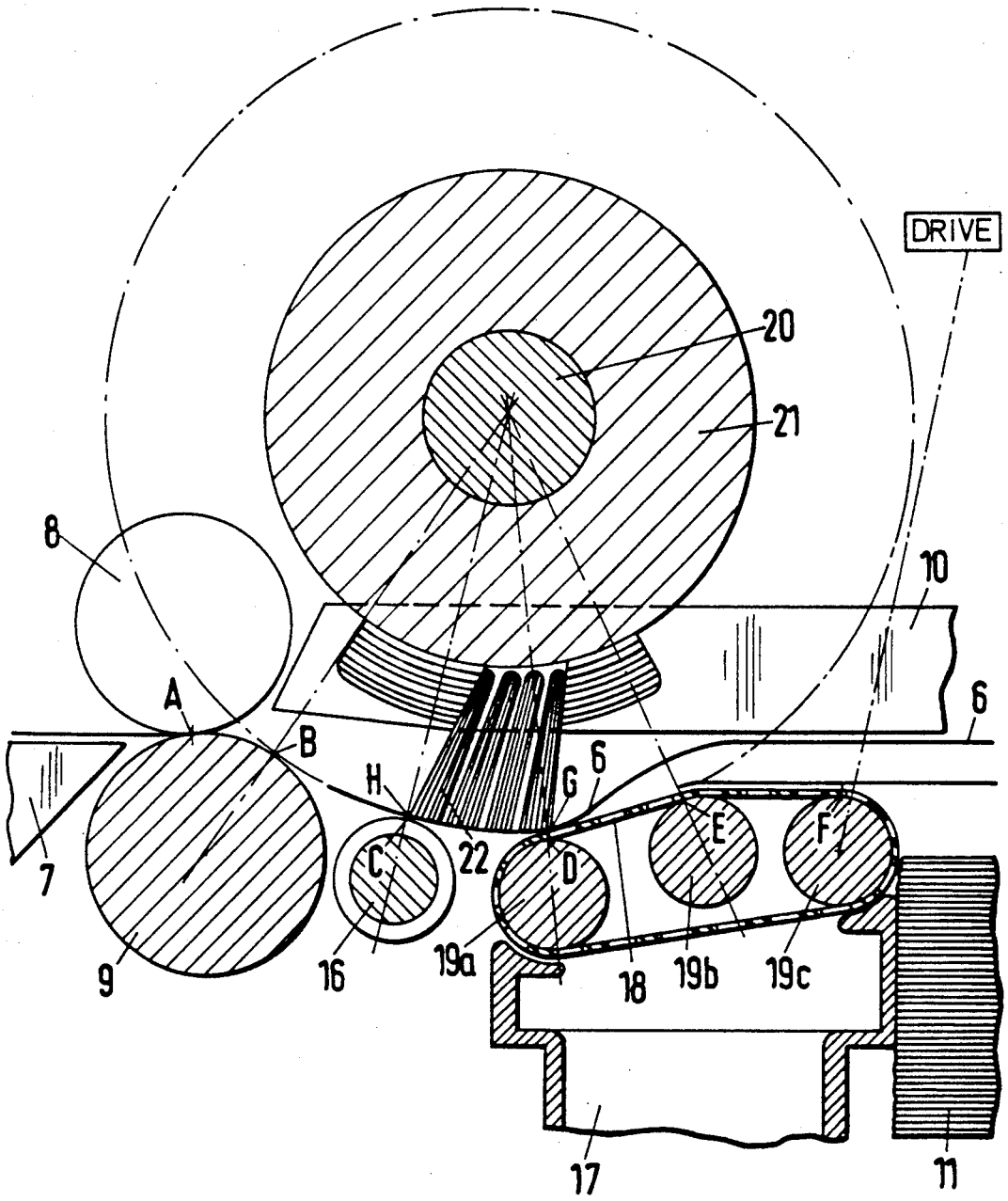

Disposed following or downstream from the conveying device 8, 9, in the travel direction of the arriving sheets 6, and immediately before or upstream of the pile or stack 11, is a combined conveying and braking device. A slide rod 16 and a suction table 17 for the combined device are disposed below the plane in which the sheets 6 are conveyed. Suction belts 18 run over rollers 19*a, b, c* (FIGS. 3 to 5). Mounted above the conveying plane is a rotating shaft 20 on which, in the zone of gaps left by the floating strips 10, mutually spaced-apart discs 21 are provided which are equipped with registering cams 22 which cooperate with elements 16 to 19 disposed below the conveying plane to perform the functions of guiding, conveying and braking. Because the conveying rollers 8 penetrate or break into the circle of rotation of the cams 22, they are disposed in gaps therebetween, i.e., in alignment with the, floating strips 10 (FIG. 2).

The conveying roller 9, the slide rod 16, the rollers 19*a* and 19*b*, with the inclusion of the suction belts 18, are associated and come in contact with the circular path of the cams 22 (FIGS. 3 to 5). There are thus provided a contact location A between the rollers 8 and the conveying roller 9; a contact location B for the cams 22 with the conveying roller 9; a contact location C with the slide rod 16; start and finish contact locations D and E with the rollers 19*a* and 19*b*, including and through the intermediary of suction belts 18; and a final contact location F for the respective sheet end with the suction belts 18, without any contact with the cams 22. The dimensions of the elements 16 to 19 are such that the distances CD and, as much as possible, BC, as well, closely agree with the cam length GH, while the distance DE should correspond to at least the cam length GH. The distances AB and EF are completely independent of the cam length GH, because the cams 22 do not contact the points A and E anyway. What is most important is the agreement of the distance CD with the cam length GH, because this is the only way in which a transition-free or uninterrupted changeover from conveying to braking is possible.

The distance BC should be at most equal to the cam length GH, because assurance is thereby provided that the sheet will be conveyed in a clearly-defined manner even after leaving the location A.

As long as the cam 22 is operative on the conveying roller 9 and/or the slide rod 16, at the locations A, B and C, the speed of the sheet 6 is equal to that determined by the conveying device 8, 9, so that the conveying action at the location C hardly requires any force by the cam 22 rotating at conveying speed. To maintain the speed of the sheet 6, therefore, it is enough for the frictional value between the cam 22 rotating at conveying speed and the sheet 6 to be higher than the frictional value between the sheet 6 and the surface of the slide rod 16, especially because the floating strips 10 exert a slight pull on the sheet 6. Besides, the time available for an accidental change in speed at the location C is very short. For example, with 36,000 sheets per hour having a length of 0.63 m and a mutual spacing between the contact locations BC and CD, respectively of 5% of the sheet length, the conveying time of the sheet end at the contact location C is only 5 milliseconds.

The overlapping and laying down or deposit of the sheet 6 is initiated by forcing the cams 22 onto the end zone of the sheet 6, due to which the sheet 6 is moved below the conveying plane, i.e., below the underside of the floating strips 10, while the end of the sheet 6 is still conveyed by the rollers 8 and the roller 9 at the contact location A (FIG. 3). The starting end G of the cams 22 reaches the contact location B on the roller 9, so that the further conveyance of the sheet 6 is independent of that length of the sheet end which has not yet passed the contact location A.

Upon further rotation of the camshaft 20, the starting end of the cams 22 reaches the contact location C of the slide rod 16, so that the further conveyance of the sheet 6 thereat remains assured when the end of the sheet 6 passes the contact location B and/or the trailing end H of the cams 22 leaves the contact location B of the roller 9 (FIG. 4).

Immediately thereafter, a fresh starting end of the web of material 1 is seized by the conveying device 8, 9 (FIG. 5) and is guided forward below the floating strips 10 behind the end H of the cams 22, and simultaneously overlaps the leading sheet 6.

Because the conveying device 8, 9 has a slight lead over the web of material 1 supplied by the crosscutter 2 to 5, the starting end of the web of material 1, is spaced both in height and in length from the end of the leading sheet 6, which is deflected vertically downwards, so that during braking there is no risk of contact between the starting end of the web of material 1 and the downwardly deflected end of the sheet 6.

The braking of the sheet 6 begins at the contact of the starting end G of the cam 22 with the start of the braking conveying distance DE, i.e., the contact location D of the roller 19*a* guiding the suction belts 18 (FIG. 5), and should be terminated at the very latest when the end of the sheet 6 reaches the start of the braking conveying distance at the location D. While yet within the period of the sheet sequence, the sheet 6 is further conveyed with the end thereof traveling over the braking conveying distance DE as far as the end E, so that, at the end of the period of the sheet sequence, the braking conveying distance DE is freed over its length for the deceleration or braking of the next sheet. To ensure that even with different conveying speeds, on the one hand, the braking conveying distance DE is completely utilized for braking while, on the other hand, ensuring that the braking distance DE is free when the cam 22 forces the next sheet onto the suction belts 18, the length of one free end of the sheet 6 is adjusted correspondingly downstream from the end H of the cam 22 via a speed-dependent phase adjustment in the drive of the camshaft 20. At the conveying speed which is conventional during production, i.e. with the exception of starting-up and stopping, the braking travel corresponds to the sum of the length GH covered by the cam and the length of the non-covered end zone.

The further conveyance of each sheet 6 over the bent-away or deviated distance EF protects the sheet against a thrust or stroke due to friction by the decelerating or braked following sheet. At both high and low conveying speeds, the end of each sheet 6 is guided, in accordance with the numerical example, at 5% of its original speed onto the sheet pile 11. Just as three sheets 6 are conveyed at their trailing ends simultaneously over the contact locations D, E and F, their starting or leading ends approach the stop strips 13 via the locations K, L and M (FIG. 1). Over the short distance from the location M to the stop strips 13, which the sheet must cover after leaving the location F without conveyance by the suction belts 18, the sheet 6 is entrained by the next following sheet due to friction. The location K lies at the end of the floating strips 10, whereat a slide comb 23 is disposed which guides onto the pile location 11 the rapidly oncoming, but only rather slowly farther sliding sheets. Three starts of the sheets 6 form a stabilizing S-curve, in which the shock of each impact of a sheet 6 against the stop strips 13 is resiliently absorbed. The air flow in the conveying direction below the floating strips 10 escapes through the slide comb 23 via the stop strips 13.

The operation of the apparatus according to the invention during start-up and while stopping, i.e., at extremely low conveying speed, differs from the operation of the apparatus as just described. At such low-speed operation, the sheet end lies below the cam 22.

Because the braking travel is very short at this slow conveying speed, the sheet end has not yet reached the location D when deceleration or braking has terminated. For this reason, as the sheet 6 is further conveyed by the suction belts 18, the end of the sheet has not yet reached the location E by the end of the sheet sequence period, so that the full length of the braking conveying distance DE is not available for the next following sheet. The lower braking force thereby produced for the following sheet is not disadvantageous, however, but rather, even offers an advantage, because it then increases the braking travel as its end approaches more closely to the location D.

The foregoing is a description corresponding in substance to German Application No. P 40 20 398.0-27, dated Jun. 27, 1990, the International priority of which is being claimed for the instant application, and which is hereby made part of this application. Any material discrepancies between the foregoing specification and the aforementioned corresponding German application are to be resolved in favor of the latter.

I claim:

1. Apparatus for overlapping and depositing sheets cut by a crosscutter from a web of material, including a conveying device disposed immediately downstream from the crosscutter in a conveying direction of the sheets for conveying the sheets at a conveying speed along a conveying path and for further guidance thereof to floating strips extending over a sheet-pile stacking location, comprising a combined conveying and braking device disposed immediately upstream of the stacking location and including a camshaft disposed above the conveying path of the sheets, said camshaft carrying conveying and braking cams and being rotatable, slide elements and brake elements disposed one after the other along a circle of rotation of said cams below said sheet conveying path and at a distance from one another corresponding to the length of said cams, means for rotating said cams at the sheet conveying speed, means for rotating said brake elements at a braking speed, said cams having a constant radius and being engageable successively with said slide elements and said brake elements both for conveying and braking each of the sheets.

2. Apparatus according to claim 1, including a drive for, said camshaft, and means for preadjusting said camshaft via a differential with increasing conveyor speed in the conveying direction so that said cams force leading ends of the sheets being conveyed a slight additional distance further forward and relatively long trailing ends of the sheets are left free downstream from said cams, the length of the free trailing ends of the sheets corresponding to an increase in braking travel of the sheets.

3. Apparatus according to claim 1, wherein said brake elements are formed as suction belts.

4. Apparatus according to claim 3, wherein said suction belts have a braking zone located in said circle of rotation of said cams, said braking zone having a length corresponding at least to said length of said cams.

5. Apparatus according to claim 4, wherein said suction belts, at a location downstream from said braking zone thereof, have a conveying zone extending outside of said circle of rotation of said cams, said suction belts being rotatable at a predetermined speed so that the respective travel path thereof over both said braking and said conveying zones is completed in a sheet sequence period.

6. Apparatus according to claim 1, wherein a first conveying element of the conveying device is cooperatively engageable with said cams below said conveying path and constitutes a conveying roller.

7. Apparatus according to claim 6, wherein said brake elements are formed as suction belts, said slide elements including a slide rod located between said conveying roller and said suction belts and engageable with said cams at a contact location spaced a distance corresponding to said length of said cams from respective contact locations of said conveying roller and said suction belts with said cams.

8. Apparatus according to claim 1, wherein said cams are carried by mutually spaced-apart discs on said camshaft, and the conveying device comprises rollers disposed in the spaces between said cams and said discs thereof.

9. Apparatus according to claim 1, wherein the same cams are in successive engagement with said slide elements and said brake elements for conveying and braking the sheets.

10. Apparatus according to claim 1, wherein said slide elements and said brake elements are cooperatively engageable, respectively, with said conveying and braking cams, and wherein only said conveying cams of said cooperating slide elements and conveying cams, and only said brake elements of said cooperating braking cams and brake elements are actionable upon the sheets for determining the speed thereof.

* * * * *